US005154815A

United States Patent [19]

O'Neill

[11] Patent Number: 5,154,815

[45] Date of Patent: Oct. 13, 1992

[54] METHOD OF FORMING INTEGRAL ELECTROPLATED FILTERS ON FLUID HANDLING DEVICES SUCH AS INK JET PRINTHEADS

[75] Inventor: James F. O'Neill, Penfield, N.Y.

[73] Assignee: Xerox Corporation, Stamford, Conn.

[21] Appl. No.: 781,694

[22] Filed: Oct. 23, 1991

[51] Int. Cl.[5] ..... C25D 1/08

[52] U.S. Cl. ..... 205/75

[58] Field of Search ..... 205/75

[56] References Cited

U.S. PATENT DOCUMENTS

| | | | |
|---|---|---|---|
| 2,933,436 | 4/1960 | Miller | 205/75 |
| 3,139,392 | 6/1964 | Mears | 156/651 |
| 3,423,261 | 1/1969 | Frantzen | 204/129.55 |
| 4,561,789 | 12/1985 | Saito | 400/120 |
| 4,589,000 | 5/1986 | Koto et al. | 346/140 R |
| 4,639,748 | 1/1987 | Drake et al. | 346/140 R |
| 4,864,329 | 9/1989 | Kneezel et al. | 346/140 R |

*Primary Examiner*—T. M. Tufariello
*Attorney, Agent, or Firm*—Oliff & Berridge

[57] ABSTRACT

A method of fabricating an integral filter on a substrate includes: blanket depositing a base layer of a metallic material on a planar surface of the substrate; depositing a patternable material layer over the base layer of metallic material; patterning a plurality of grid lines in the paternable material layer to form a filter pattern; depositing metallic material in the grid lines of the filter pattern by electroplating, to form a filter over the base layer; removing the patternable material layer from the planar surface; and removing the base layer of metallic material at least between the grid lines of the electroplated filter. Preferably, the substrate is part of a fluid handling device, and therefore, includes a through-hole over which the filter is fabricated. Usually, the filter is fabricated prior to forming the through-hole. In one example, the fluid-handling device is a channel plate for a thermal ink jet printhead.

13 Claims, 5 Drawing Sheets

METHOD OF FORMING INTEGRAL ELECTROPLATED FILTERS ON FLUID HANDLING DEVICES SUCH AS INK JET PRINTHEADS

BACKGROUND OF THE INVENTION

1. Field of the Invention

The present invention is directed to methods of forming filters by electroplating a metallic material onto a substrate, and in particular to methods of fabricating thermal ink jet printheads having electroplated filters integrally formed thereon.

2. Description of Related Art

A typical thermally actuated drop-on-demand ink jet printing system uses thermal energy pulses to produce vapor bubbles in an ink-filled channel that expels droplets from the channel orifices of the printing system's printhead. Such printheads have one or more ink-filled channels communicating at one end with a relatively small ink supply chamber (or reservoir) and having an orifice at the opposite end, also referred to as the nozzle. A thermal energy generator, usually a resistor, is located in the channels near the nozzle at a predetermined distance upstream therefrom. The resistors are individually addressed with a current pulse to momentarily vaporize the ink and form a bubble which expels an ink droplet. A meniscus is formed at each nozzle under a slight negative pressure to prevent ink from weeping therefrom.

Some of these thermal ink jet printheads are formed by mating two silicon substrates. One substrate contains an array of bubble generating heater elements and associated electronics (and is thus referred to as a heater plate), while the second substrate is a fluid directing portion containing a plurality of nozzle-defining channels and an ink-fill-hole for providing ink from a source to the channels (thus, this substrate is referred to as a channel plate). The channel plate is fabricated usually by orientation dependent etching methods.

Droplet directionality of ink expelled from these printheads can be significantly influenced by extrinsic particles finding their way into the printhead channels. In order to address this problem, a metal mesh filter has been laminated to an ink inlet side of the channel plate after assembly of the two wafers. Providing the laminated filter is a costly processing step. The filter must meet specific standards for corrosion resistance (some inks are corrosive) and usually are only available from vendors in specific sizes.

U.S. Pat. No. 4,561,789 to Saito discloses a thermal ink transfer printing system containing a thermal printing head comprised of a porous glass substrate which is covered with a polyimide thin film and consequently photoetched to produce a pattern of holes comprising an ink filter.

U.S. Pat. No. 4,639,748 to Drake et al discloses an ink jet printhead having an internal filtering system and fabricating process therefore. Each printhead is composed of two parts aligned and bonded together. One part contains a linear array of heating elements and addressing electrodes on one surface. The other part has a parallel array of elongated recesses for use as ink channels and a common ink supplying manifold recess in communication with the ink channels. The manifold recess contains an integral closed wall defining a chamber with an ink-fill hole. Small passageways are formed in the internal chamber walls to permit passage of ink therefrom into the manifold. Each of these passageways have smaller cross-sectional flow areas than the nozzles to filter the ink, while the total cross-sectional flow area of the passageways is larger than the total cross-sectional flow areas of the nozzles.

U.S. Pat. No. 4,864,329 to Kneezel et al discloses a thermal ink jet printhead having a flat filter placed over an inlet thereof by a fabrication process which laminates a wafer sized filter to aligned and bonded wafers containing a plurality of printheads. The individual printheads are obtained by a sectioning operation, which cuts through the two or more bonded wafers and the filter. The filter may be a woven mesh screen or preferably an electroformed screen with predetermined pore size. Since the filter covers one entire side of the printhead, a relatively large contact area prevents delamination and enables convenient leak-free sealing.

One problem associated with laminating a wafer sized filter mesh to an aligned and bonded wafer pair is that the filter mesh must be diced through when separating the multiple printheads from the bonded wafers. This damages the dicing blades, reducing their useful life, and can also cause delamination of the filter mesh from edges of the printheads.

U.S. Pat. No. 4,589,000 to Koto et al discloses a drop-on-demand ink jet printer which includes an integral ink jet head and ink jet container. An ink supply port includes a filter (see FIGS. 17–25). The filter is mechanically secured to a substrate by heat, and can be prepared by electroforming a nickel sheet.

U.S. Pat. application No. 07/624,390 to Michael R. Campanelli et al, filed Dec. 6, 1990, discloses an ink jet printhead having an integral membrane filter formed over the inlet of a channel-containing portion thereof. The integral membrane filter is formed on a channel wafer after it is anisotropically etched, and prior to mating with a heater plate wafer. A photopatternable layer is deposited over an etch resistant masking layer and exposed, patterned and developed to establish the mesh filter. In another embodiment, a side of the channel wafer not patterned and etched is heavily doped to increase the robustness of the membrane filter by functioning as an etch stop. This doped region beneath the patternable layer is then etched using the membrane filter as a mask to open the filter pores through the doped layer portion of the channel wafer.

Unlike U.S. Pat. application No. 07/624,390, the present invention fabricates filters from electroplated metallic material. Additionally, some metallic materials, such as, for example, gold are resistant to corrosion by many inks.

One problem associated with thermal ink jet technology is the sensitivity of ink droplet directionality to particles in the ink. Print quality is directly related to accurate placement of the ink droplets on a recording medium, and droplet directionality determines the accuracy of the ink droplet placement. It has been demonstrated that higher print quality is achieved with particulate-free ink sources and the degree of particulate-free ink is related to how close the final filtration of the ink is to the ink jet printhead. One source of particulate contamination is the manufacturing environment itself. At least a partial solution to particulate-induced misdirectionality problems is to construct the entire transducer structure in a clean environment. However, complete particle-free environments are not practical. This invention solves the problems of particle contamination during the fabrication of an ink jet printhead.

OBJECTS AND SUMMARY OF THE INVENTION

It is an object of the present invention to provide a method of fabricating an integral electroplated metallic filter on a substrate, such as, for example, a fluid handling device, the filter being corrosion resistant, dimensionally easy to modify, and low in manufacturing cost.

It is another object of the present invention to provide an integral electroplated metallic filter fabricated on a channel plate of a printhead which prevents dirt and debris from entering ink inlets during further processing to allow the use of less expensive, less stringently clean assembly rooms for manufacture of printheads.

To achieve the foregoing and other objects, and to overcome the shortcomings discussed above, a filter is integrally fabricated on a substrate by electroplating a metallic material into grid lines formed in a photopatternable material layer on the substrate. A base layer of metallic material is blanket deposited on the substrate prior to deposition of, and grid line formation in, the photopatternable material layer. After electroplating the filter, the photopatternable material layer and the base layer of metallic material located between the grid lines (i.e. within pores of the filter) are removed. A through-hole is formed in the substrate from the opposite side so that the substrate can be used as a fluid handling device. Since the filter can be located over the through-hole, any fluid (liquid or gaseous) passing through the through-hole will be filtered.

Filters according to the present invention can be fabricated on channel plate wafers (opposite from the channel side) used to form ink jet printheads. Since conventional photopatterning techniques are used to delineate the filters, these filters can be precisely located only over portions of the channel plate wafer which contain the through-holes, thus avoiding dicing through the filter material. Since metallic materials such as gold are highly resistant to corrosion by many inks, superior filtration of ink for the entire useful life of the printheads is achieved.

BRIEF DESCRIPTION OF THE DRAWINGS

The invention will be described in detail with reference to the following drawings wherein.

DETAILED DESCRIPTION OF THE PREFERRED EMBODIMENTS

The present invention will be described in connection with the fabrication of an integral electroplated filter on the channel plate of an edge-shooter-type thermal ink jet printhead. It is understood that the fabrication process of the present invention can be used to fabricate electroplated filters for other applications. The present invention is particularly useful for fabricating electroplated filters on fluid handling elements (i.e., elements which contain passages for conveying liquid and/or gas). However, the present invention can also be used to fabricate filters which are later adhered to other substrates. Thus, the described embodiments are intended to be illustrative, not limiting.

Figure 1:
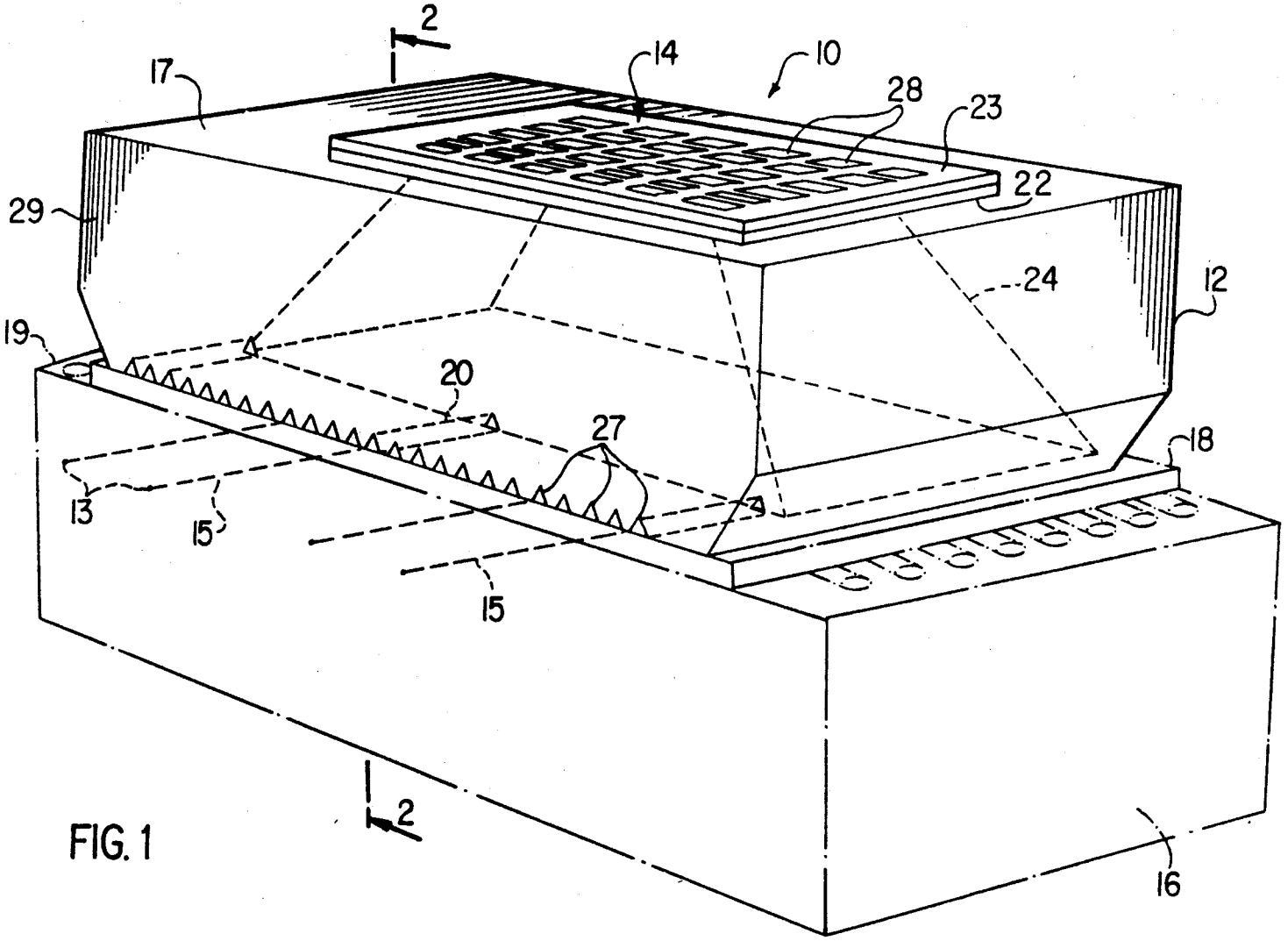
FIG. 1 is a partial enlarged perspective view of a single printhead having an integral electroplated filter fabricated according to the present invention, and showing the ink droplet emitting nozzles.
Figure 2:
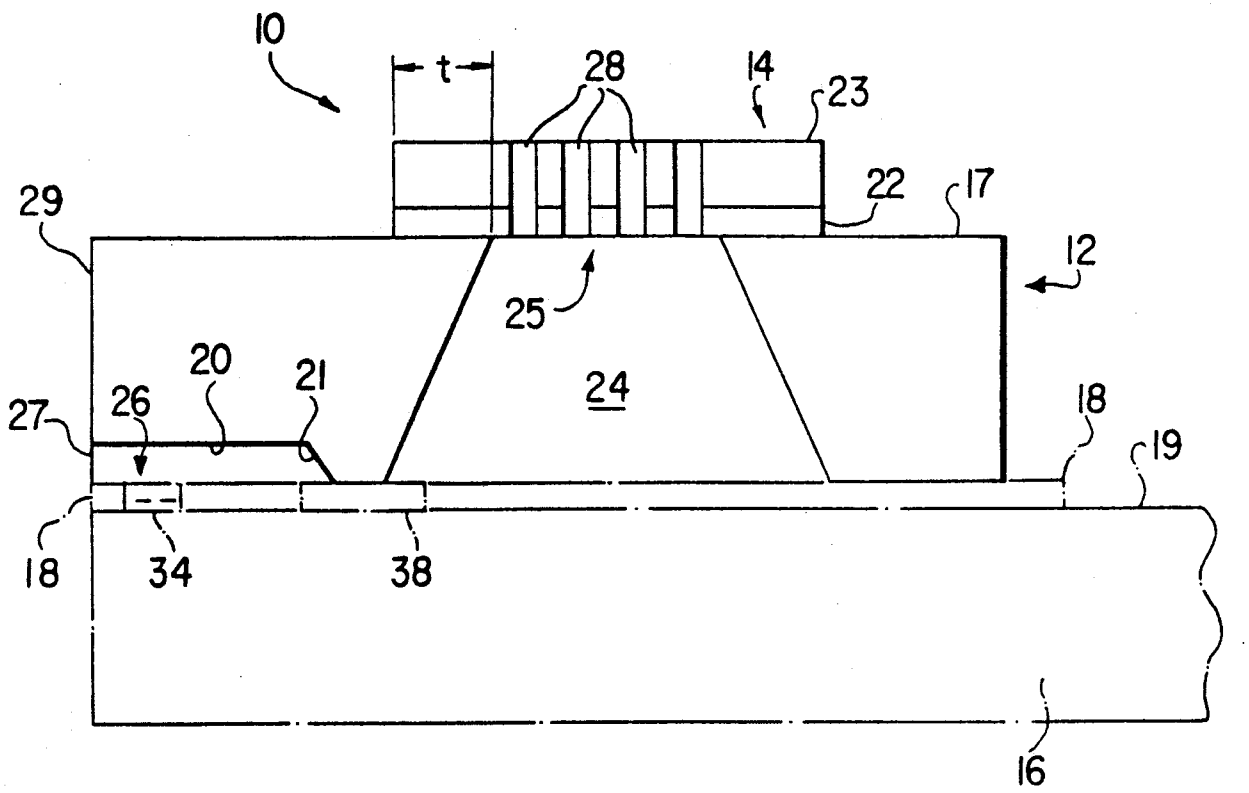
FIG. 2 is a cross-sectional view of the printhead as viewed along line 2—2 of FIG. 1.

In FIGS. 1 and 2, a thermal ink jet printhead 10 fabricated according to the teachings of the present invention is shown comprising channel plate 12 with integral filter 14 and heater plate 16 shown in dashed line. A patterned film layer 18 is shown in dashed line having a material such as, for example, Riston®, Vacrel®, or polyimide, and is sandwiched between the channel plate and the heater plate. As disclosed in U.S. Pat. No. 4,774,530 to Hawkins and incorporated herein by reference in its entirety, the thick film layer is etched to remove material above each heating element 34, thus placing them in pits 26, and to remove material between the closed ends 21 of ink channels 20 and the reservoir 24, forming trench 38 in order to place the channels 20 into fluid communication with the reservoir 24. For illustration purposes, droplets 13 are shown following trajectories 15 after ejection from the nozzles 27 in front face 29 of the printhead.

Referring to FIG. 1, the printhead comprises a channel plate 12 that is permanently bonded to heater plate 16 or to the patterned thick film layer 18 optionally deposited over the heating elements and addressing electrodes on the top surface 19 of the heater plate and patterned as taught in the above-mentioned U.S. Pat. No. 4,774,530. The channel plate is silicon and the heater plate may be any insulative or semiconductive material as disclosed in U.S. Reissue Pat. No. 32,572 to Hawkins et al. The illustrated embodiment of the present invention is described for an edge-shooter type printhead, but could readily be used for a roofshooter configured printhead (not shown) as disclosed in U.S. Pat. No. 4,864,329 to Kneezel et al, wherein the ink inlet is in the heater plate, so that the integral filter of the present invention could be fabricated in an identical manner thereover. The description of FIGS. 8 and 9 of U.S. Pat. No. 4,864,329 is incorporated herein by reference.

Channel plate 12 of FIG. 1 contains an etched recess 24, shown in dashed line, in one surface which, when mated to the heater plate 16, forms an ink reservoir. A plurality of identical parallel grooves 20, shown in dashed line and having triangular cross sections, are etched (using orientation dependent etching techniques) in the same surface of the channel plate with one of the ends thereof penetrating the front face 29. The other closed ends 21 (FIG. 2) of the grooves are adjacent to the recess 24. When the channel plate and heater plate are mated and diced, the groove penetrations through front face 29 produce the orifices or nozzles 27. Grooves 20 also serve as ink channels which contact the reservoir 24 (via trench 38) with the nozzles. The open bottom 25 of the reservoir in the channel plate, shown in FIG. 2, provides means for maintaining a supply of ink in the reservoir through a manifold from an ink supply source (not shown).

Filter 14 of the present invention has been fabricated, as discussed later, by electroplating a metallic material filter layer 23 over a blanket deposited metallic material base layer 22 (which can be vacuum deposited). The filter layer 23 is electroplated into a grid-pattern formed in a photopatternable material so as to be deposited in the form of a filter mesh. The photopatternable material is then removed between the grid lines of the electroplated filter layer 23 (i.e., to form the apertures or pores through the filter layer). Portions of base layer 22 corresponding to pores 28 are then removed so that pores 28 extend to reservoir inlet 25. The apertures or pores 28 have predetermined sizes in the range of 5–30 μm length, width, or diameter through the two layers in an area equal to and in alignment with the open bottom 25 of the reservoir 24. The layers 22, 23 may cover the entire upper surface 17 of the channel plate or may be etch removed to an area slightly larger than the reservoir open bottom 25 which serves as the ink inlet, as shown in FIGS. 1 and 2. Alternatively, when the channel plate wafer contains alignment structure on both sides thereof (e.g. alignment holes) the blanket layer 22 and filter layer 23 can be precisely deposited only over an area on surface 17 slightly larger than open bottom 25 of reservoir 24. The filter size must be large enough to provide an adequate seal around the reservoir open bottom 25 with enough adhering surface area to prevent delamination. Referring to FIG. 2, the distance "t" represents the minimum dimension between the outer periphery of the filter 14 and the internal dimensions of the open end 25; the distance is preferably about 25 to 200 μm.

The fluid resistance is very low because the filter is extremely thin and can be made with relatively high fluid transmission values. For example, a 4 micron thick filter in a 1,000 line per inch square grid pattern with an 18 micron square pore size, which is suitable for the present invention, has a transmission value of 50%. Other pore shapes and filter thicknesses are acceptable, so long as the pore area is about 50% of the inlet area and the filter thickness is within 2 to 10 μm.

In addition to filtering out contamination from the ink and ink supply system during printing, the filter also keeps dirt and other debris from entering the relatively large inlets during printhead assembly. In this way, it is possible to use less stringently clean and, therefore, less expensive assembly rooms for printhead manufacture after the filter has been fabricated.

As previously mentioned, it is possible to fabricate the filter of the present invention on the entire side of a substrate, or only over a portion of the substrate having a through-hole. In the presently described illustration, the substrate is a channel plate wafer of <100> silicon upon which a plurality of channel plates are fabricated using conventional orientation dependent etching (ODE) techniques. These channel plates are arranged in a plurality of columns and rows so that a matrix of channel plates are formed on each wafer. The channel plate wafer can be separated between the columns and rows (by, for example, dicing) to delineate a plurality of channel plates. These channel plates are then bonded to heater plates. Preferably, the channel plate wafer is bonded to a heater plate wafer (which contains a plurality of heater plates arranged in a matrix thereon), and then the channel plate/heater plate bonded wafer pair is separated to form a plurality of printheads as illustrated in FIGS. 1 and 2. See, for example, U.S. Pat. No. 4,878,992 to Campanelli, U.S. Pat. No. 4,851,371 to Fisher et al, U.S. Pat. No. 4,829,324 to Drake et al and the above-mentioned U.S. Reissue Pat. No. 32,572 to Hawkins et al, the disclosures of which are incorporated herein by reference.

If the filters are formed only over portions of the channel plate wafer through which reservoir hole 24 extends, then a silicon wafer containing alignment holes extending therethrough is used so that the filters (formed on a second surface 17 of the wafer) can be precisely aligned with the reservoir holes (which are formed by defining etch-patterns on a first side 11 of the wafer). The formation of alignment holes is well known and only briefly described herein. In order to form alignment holes, a nitride mask is plasma deposited on both sides of a two-side polished <100> silicon wafer. For example, silicon nitride can be deposited as a mask having a thickness of about 1500 Å. A photopatternable layer is then deposited on one side of the wafer. Materials suitable for use as a photopatternable layer include, for example, KTI 820 positive resist, KTI 747 negative resist, photoimageable polyimide, and VACREL®. The photopatternable layer is patterned, by exposure and development, to form alignment apertures through the photopatternable layer. This is followed by plasma etching through the nitride mask to form vias (corresponding to the alignment apertures) in the nitride mask. The photopatternable layer is removed, and holes are orientation dependently etched entirely through the silicon wafer (through the vias in the nitride mask) by an etchant such as, for example, KOH, followed by removal of the nitride layers. This forms alignment holes through the wafer. This alignment hole fabrication process is known in the art and does not form part of the present invention. Of course, alignment patterns can be formed on the wafer substrate by other means.

Figure 3A:
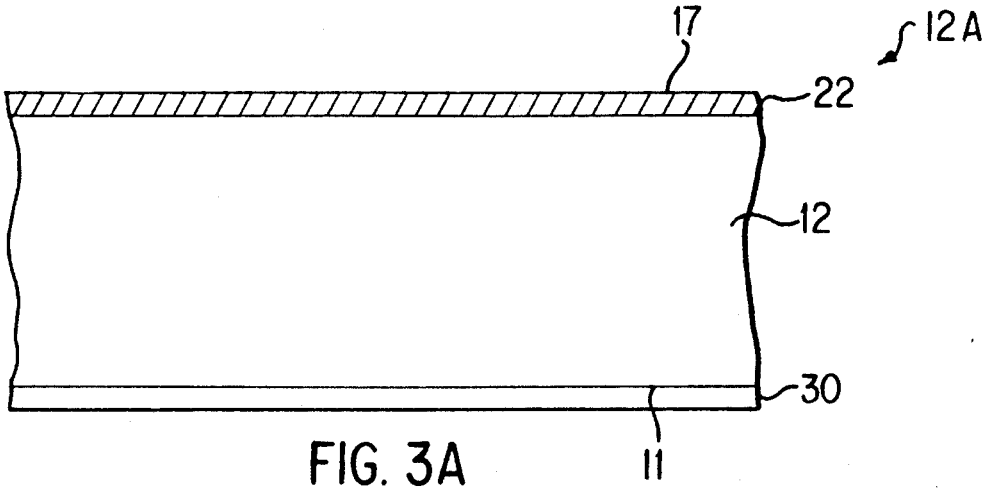
FIGS. 3A-3G are partial cross-sectional views of the channel plate fabricating steps which include the fabrication of the integral electroplated metallic filter.

The fabrication process for the channel plate having an integral electroplated filter over its ink inlet is shown in FIGS. 3A–3G, each being partial, cross-sectional views of a <100> silicon wafer 12A and showing substantially only one of a plurality of channel plates 12. After the wafer is chemically cleaned, and alignment patterns (if any) are formed, an etch resistant patternable layer 30 such as, for example, silicon nitride, is formed on a first planar surface (channel side) 11 of wafer 12A as shown in FIG. 3A. This etch resistant layer 30 is resistant to the etchants used to orientation dependently etch through the <100> silicon wafer. A preferred process for depositing patternable etch resistant layer 30 on first surface 11 involves: (a) depositing a patternable etch resistant layer on both the first and second surfaces 11, 17 of wafer 12A (this deposition process results in patternable etch resistant material being deposited on all exposed surfaces of wafer 12A); (b) depositing a photopatternable layer (not shown) over the etch resistant layer 30 on channel side 11 (in order to protect layer 30); (c) removing the etch resistant layer from filter side 17 by plasma etching or by wet etching; and (d) removing the photopatternable layer from layer 30. Other processes for depositing etch resistant layers other than silicon nitride can also be employed.

A metallic material layer 22 is blanket deposited (by, for example, vacuum deposition) on a filter side 17 of the wafer 12A as also shown in FIG. 3A. Preferably, the metallic material is gold (Au), but other metals may be substituted. The basic criteria is a metallic material which is corrosion-resistant and which is inert to a particular ink to be used with the device. Other metallic materials such as, for example, nickel and chromium can be used as long as they meet the above criteria. Base layer 22 has a thickness in the range between 1000 Å and 5000 Å, and is preferably about 3000 Å thick.

Figure 3B:
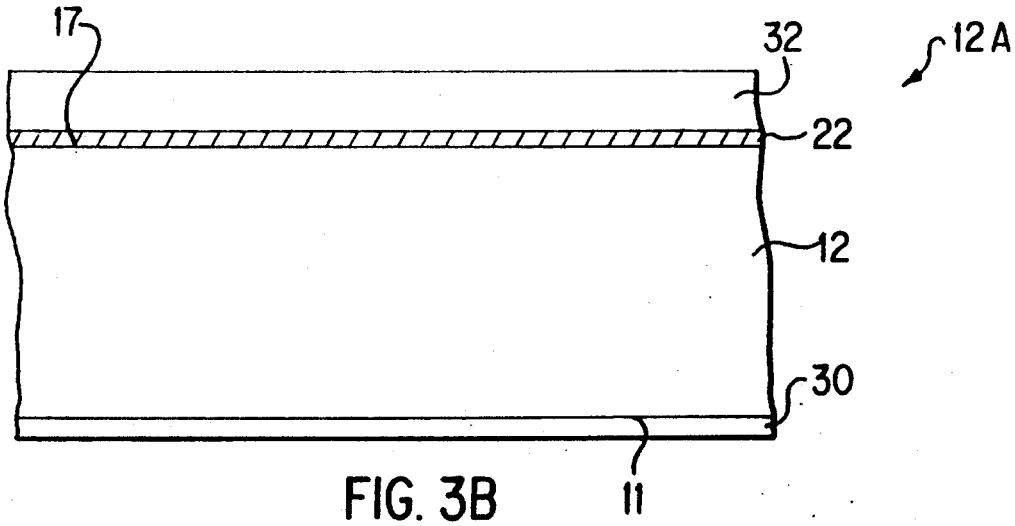
Figure 3C:
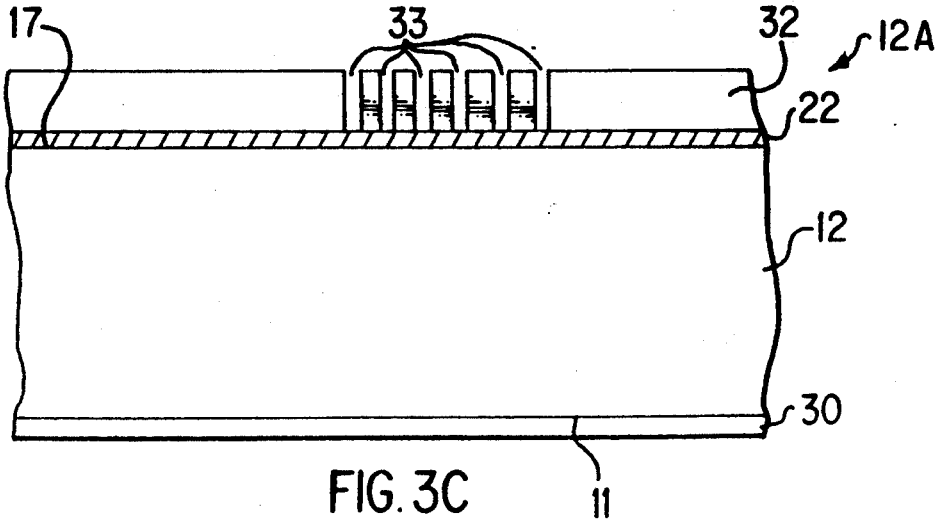

A photopatternable layer 32 is then deposited on base layer 22 as shown in FIG. 3B. Photopatternable layer 32 has a thickness in the range between 2 and 25 μm. Photopatternable layer 32 is then photolithographically patterned (i.e., exposed and developed) to form a plurality of overlapping grid lines 33 therein as shown in FIG. 3C. The grid lines 33 extend down to base layer 22, as shown in FIG. 3C, and define the filter pattern. Portions of the photopatternable layer 32 between the grid lines 33 will become the pores 28 of filter 14. FIGS. 3A–3G illustrate the present invention as used to form filters on a silicon wafer substrate 12A having alignment holes therein. Accordingly, the mask (not shown) used to pattern the grid lines 33 in the photopatternable layer 32 can be precisely aligned with the mask (not shown) which will be used to form reservoir hole 24 on first surface 11, so that the filters 14 can be formed only over a portion of second surface 17 corresponding to and slightly larger than the size of the open bottom 25 (or inlet) of reservoir 24. If no alignment holes are formed through wafer 12A, the filter pattern would extend over the entire second surface 17 of wafer 12A to ensure that each bottom end 25 in wafer 12A is covered by a filter.

Figure 3D:
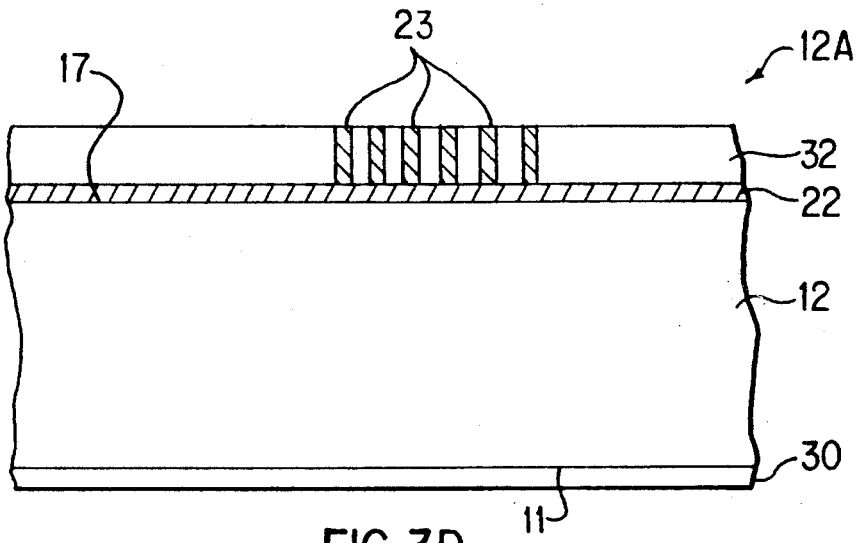

Next, as illustrated in FIG. 3D, metallic material 23 is electroplated into grid lines 33 to form the filter over base layer 22. Filter layer 23 has a thickness in the range between 2 μm and 10 μm. In this metallic material used for filter layer 23 is the same type of metallic material used as base layer 22 (i.e., gold). However, the materials used for layers 22 and 23 could differ. Additionally, an intermediate layer (not shown) could be deposited on filter surface 17 of wafer substrate 12A prior to deposition of base layer 22 if adherence of the base layer to the substrate is a problem. For example, chromium or titanium could be deposited on surface 17 of silicon substrate 12A to assist in the adherence of gold base layer 22 thereon.

Figure 3E:
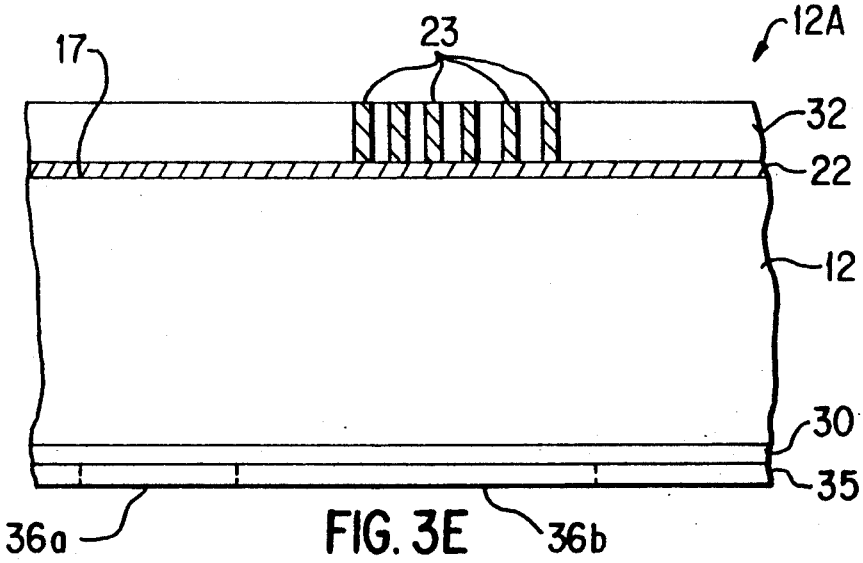
Figure 3F:
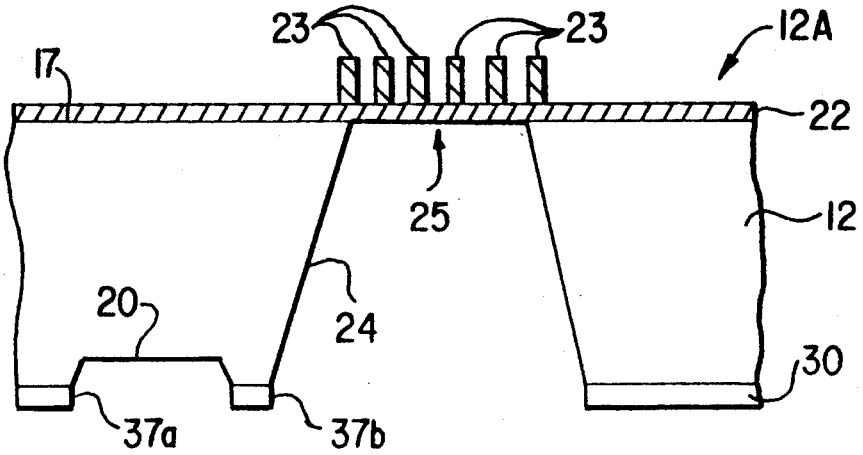
Figure 3G:
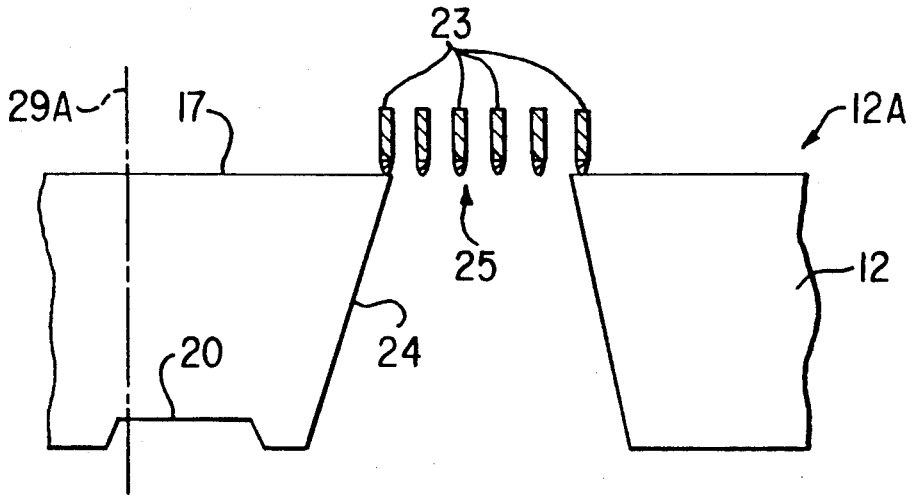

As shown in FIGS. 3E–3F, a plurality of channel-defining grooves or vias **37*a* (only one channel-defining groove is shown), and at least one reservoir-defining hole or via 37*b* are patterned in etch resistant layer 30. This is done in a conventional manner, as illustrated in FIG. 3E, by: (a) depositing a photopatternable layer 35 over etch resistant layer 30; (b) photolithographically patterning channel-defining apertures 36*a* and reservoir-defining apertures 36*b* in layer 35; and (c) plasma etching through apertures 36*a* and 36*b* to form vias 37*a* and 37*b***.

Once vias **37*a* and 37*b* are formed in etch resistant layer 30, channels 20 and reservoir holes 24 are orientation dependently etched through wafer 12A** using, for example, KOH.

A protective layer (not shown) of, for example, Riston®, Vacrel®, or polyimide can be formed over filter layer 23, prior to deposition of photopatternable layer 35 to protect filter layer 23 (since wafer 12A is usually positioned with surface 17 face down on a support during patterning of etch resistant layer 30). Prior to KOH etching wafer 12A to form channels 20 and reservoirs 24, the protective (e.g., Vacrel®) layer is removed from filter layer 23, as well as photopatternable layers 32 and 35. These layers could also be removed by the KOH, however, this would cloud the KOH bath. The structure resulting after etching channels 20 and reservoirs 24 is shown in FIG. 3F.

Next, the metallic base layer 22 is stripped using, for example, either ion milling or a suitable etchant for the metal material used to form the base layer 22, to open pores 28 between the metallic filter grid lines. For example, when base layer 22 is formed from gold, potassium iodide etching solution can be used to open pores 28 through base layer 22. Although some portions of layer 23 are also removed, since layer 23 is much thicker than base layer 22, most of layer 23 remains after the exposed portions of base layer 22 (i.e., the portions not covered by layer 23) are removed. Finally, silicon nitride layer 30 is removed to form the channel wafer 12A shown in FIG. 3G having an integral electroplated filter 14 thereon. Dashed line 29A represents the cutting lines for separating the printheads, after alignment and bonding of heater plate and channel plate wafers together, so that channels 20 are opened to form nozzles 27.

If the filter pattern is formed over the entire second surface 17 of wafer substrate 12A (i.e., when no alignment holes are formed through wafer substrate 12A), portions of the filter can either be left on surface 17 between openings 25 (in which case, the filter will have to be cut through during the step of separating printheads out of the bonded heater plate/channel plate wafer pairs) or these portions could be removed. In order to remove portions of filter 14 (i.e., layers 22 and 23) located between openings 25, a protective layer of, for example, Riston®, Vacrel®, or polyimide could be deposited and patterned over the portions of filter 14 corresponding to, and slightly larger than, openings 25. Then the non-protected areas of filter 14 could be removed by ion milling or by potassium iodide etching. Then, the protective layer would be removed. The protective layer can be precisely located over openings 25, because the openings 25 would be visible from the second surface 17 of wafer substrate 12A.

The steps described above need not be performed in the exact order illustrated in FIGS. 3A–3G. For example, after base layer 22 is deposited, the channel-pattern **37*a* and manifold-pattern 37*b* could be photoprocessed prior to deposition of photopatternable layer 32. Preferably, the wafer 12A is not etched in KOH until after filter layer 23 is deposited since base layer 22 is very thin, and might rupture if reservoir hole 24 were formed prior to electroplate deposition of filter layer 23**.

Figure 4:
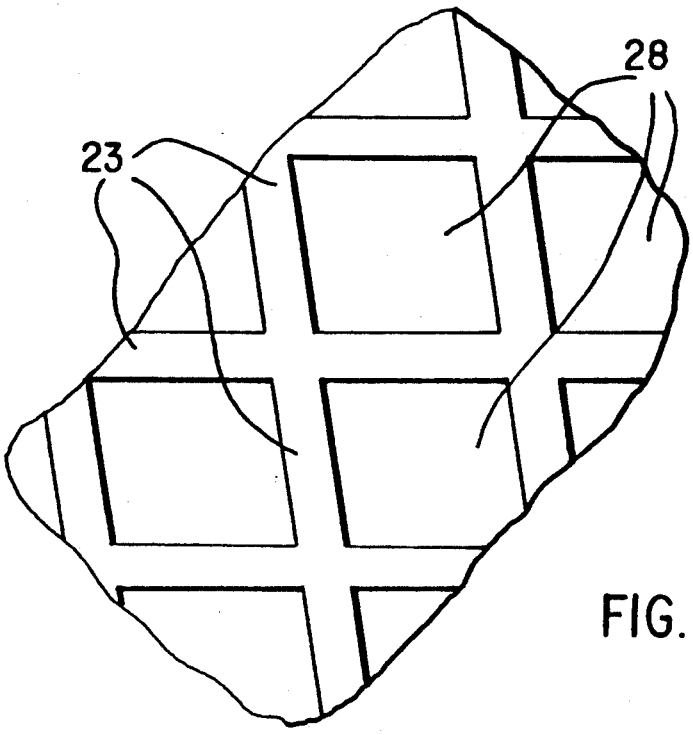
FIG. 4 is an enlarged plan view of a portion of a filter formed according to the present invention.

FIG. 4 is an enlarged plan view of a portion of a filter formed by the present invention. The shape and size of the filter, grid lines and pores 28 can vary from the example shown in the drawings.

In addition to filtering out contamination from the ink and ink supply system during printing, the filter also keeps dirt and other debris from entering the relatively large ink inlets during subsequent printhead assembly. In this way, the printhead assembly process can be performed in less expensive, less stringently clean assembly rooms after the filter has been formed.

The invention has been described with reference to the preferred embodiments thereof, which are illustrative and not limiting. Various changes may be made without departing from the spirit and scope of the invention as defined in the appended claims.

What is claimed is:

1. A method of fabricating a channel plate for an ink jet printhead, comprising:

a) depositing a patternable etch resistant layer on a first planar surface of a substrate, said substrate also having a second planar surface parallel to and opposite from said first planar surface;

b) blanket depositing a base layer of a metallic material on said second planar surface of said substrate;

c) depositing a photopatternable material layer over said base layer of metallic material;

d) patterning a plurality of grid lines in said photopatternable material layer to form a filter pattern;

e) depositing metallic material in the grid lines of said filter pattern by electroplating, to form a filter over said base layer;

f) patterning a plurality of channel-defining grooves and at least one opening in said patternable etch resistant layer on said first planar surface of said wafer;

g) etching a plurality of channels in said first surface of said wafer, and etching a reservoir hole through said wafer from said at least one opening in said patternable etch resistant layer to said second planar surface;

h) removing said patternable etch resistant layer from said first planar surface and said photopatternable material layer from said second planar surface; and i) removing said base layer of metallic material at least between the grid lines of said electroplated filter.

2. The method of claim 1, wherein said substrate is a two-side polished <100> silicon wafer, and said channels and reservoir hole are anisotropically etched in step (g).

3. The method of claim 2, wherein a plurality of sets of channel-defining grooves and corresponding openings are patterned in said etch resistant layer so that a plurality of sets of channels and reservoir holes are etched in said substrate, said plurality of sets being arranged in plural rows and columns so as to form a matrix of channel plates in said substrate; and further comprising:

separating said substrate between said rows and said columns.

4. The method of claim 1 further comprising:

depositing a protective overcoat layer over said filter after said electroplating step.

5. The method of claim 1, wherein said filter is formed over an entire surface area of said second planar surface.

6. The method of claim 1, wherein said filter is formed only over a portion of said second planar surface corresponding to, and slightly larger than a size of said reservoir opening in said second planar surface.

7. The method of claim 1, wherein step (f) is performed-prior to performing step (c).

8. The method of claim 1, wherein said substrate includes an alignment pattern on said first and second planar surfaces, and wherein said grid lines are patterned and electroplated with filter metallic material in said photopatternable material layer only on portions of said second planar surface corresponding to, and slightly large in size than a size of said holes formed on said second planar surface by step (g).

9. The method of claim 2, wherein the metallic material forming said base layer is the same type of metallic material that forms said filter pattern.

10. The method of claim 9, wherein said metallic material is gold.

11. The method of claim 10, further comprising:

depositing an intermediate material layer on said second planar surface of said substrate prior to blanket depositing said base layer on said substrate, said intermediate material layer improving the adherence of said base layer to said second planar surface of said substrate.

12. The method of claim 11, wherein said intermediate material is chromium.

13. The method of claim 10, wherein said base layer has a thickness in the range between 1000 Å and 5000 Å, and said filter pattern metallic material has a thickness in the range between 2 μm and 10 μm.

* * * * *